US007690926B2

(12) United States Patent
Yeh et al.

(10) Patent No.: US 7,690,926 B2
(45) Date of Patent: Apr. 6, 2010

(54) ELECTRICAL CONNECTOR ASSEMBLY WITH STIFFENER

(75) Inventors: Cheng-Chi Yeh, Tu-cheng (TW); Ke-Hao Chen, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/317,405

(22) Filed: Dec. 22, 2008

(65) Prior Publication Data

US 2009/0163068 A1 Jun. 25, 2009

(30) Foreign Application Priority Data

Dec. 21, 2007 (CN) ..... 2007 2 0131641 U

(51) Int. Cl.
*H01R 13/62* (2006.01)

(52) U.S. Cl. ..... 439/73; 439/331

(58) Field of Classification Search ..... 439/73, 439/331, 71, 525, 526
See application file for complete search history.

(56) References Cited

U.S. PATENT DOCUMENTS 6,877,990 B2 4/2005 Liao
6,908,327 B2 6/2005 Ma
6,948,947 B2 * 9/2005 Lee et al. ..... 439/73
7,001,197 B2 2/2006 Shirai
7,160,130 B2 * 1/2007 Ma ..... 439/331
7,189,093 B2 * 3/2007 Ma ..... 439/331
7,278,860 B2 * 10/2007 Ma ..... 439/73
7,435,124 B2 * 10/2008 Ma et al. ..... 439/331
2006/0057878 A1 * 3/2006 Szu ..... 439/331
2006/0148297 A1 * 7/2006 Ma ..... 439/331

* cited by examiner

*Primary Examiner*—Gary F. Paumen
(74) *Attorney, Agent, or Firm*—Andrew C. Cheng; Wei Te Chung; Ming Chieh Chang

(57) ABSTRACT

An electrical connector assembly comprises a stiffener including a base with a first portion and a second portion, insulative housing, a load plate and a lever. An embossed portion is formed on the base and has substantial distance to a first end of the first portion. An insulative housing is disposed between the first portion and the second portion. A load plate is pivotally mounted on the second portion of the stiffener. A lever is pivotally assembled to the first portion of the stiffener to lock the load plate and includes a retaining portion adjacent to the embossed portion to abut against the lever when it is rotated.

16 Claims, 7 Drawing Sheets

ELECTRICAL CONNECTOR ASSEMBLY WITH STIFFENER

BACKGROUND OF THE INVENTION

1. Field of the Invention

The present invention relates to an electrical connector assembly, and more particularly to an electrical connector assembly with an improved stiffener for properly supporting a lever rotationally assembled thereon to prevent the lever from bending during servicing.

2. Description of the Prior Art

U.S. Pat. No. 6,877,990 issued to Liao on Apr. 25, 2005 discloses a land grid array (LGA) connector assembly includes a LGA connector and a generally rectangular pick up cap. The connector including an insulative housing, a plurality of contacts received in the housing, a lever, and a metal clip. The housing defines a cavity for receiving an LAG central processing unit (CPU) therein. The clip is disposed on the housing to press the CPU upon the contacts. The pick up cap is generally rectangular, and has a plurality of clasps at two opposite ends thereof. The clasps snappingly clasp edges of the clip of the connector, thereby securely mounting the pick up cap onto the connector. As shown in FIG. 1 and FIG. 4, the clip has an engaged portion to engage with an actuating portion of the lever. The engaged portion has an inclined surface at the tip thereof. Thus, the lever will be easily slided from the engaged portion.

U.S. Pat. No. 6,908,327 and U.S. Pat. No. 7,001,197 both disclose a LGA socket have above said problem. Now, let's detail describe the truth of the problem as follows.

FIG. 1 to FIG. 3 show a conventionally electrical connector 100 typically used for electrically connecting an electronic package (not shown) and a printed circuit board (not shown). The electrical connector comprises an insulative housing 1, a plurality of contacts (not shown) received in the insulative housing 1, a stiffener 2 surrounding the insulative housing 1, a lever 3 pivotally mounted on a rear end of the stiffener 2, and a cover 4 pivotally mounted on a front end of the stiffener 2. The stiffener 2 is substantial rectangular and has four sidewalls 21 extending downwardly from periphery thereof. The lever 3 is mounted on a pair of longitudinal sides 21 of the stiffener 2. There is a space between the lever 3 and the rear sidewall 21 has a space for disposing other members. The rear end of the cover 4 has a tongue 41 extending downwardly with an incline 411 at a tip. When the electrical connector 100 is working, the lever 3 locks the tongue 41 of the load plate 4. However, when the electronic package is thicker or the lever 3 is a little far from the tongue 41 of the load plate 4, the lever 3 will just engage with the incline 411 and bear a rearward and upward force F. As shown in FIG. 2, the force F can be broken into a rearward force Fx and an upward force Fy. Referring to FIG. 3, since there is no restriction acted on the rear of the lever 3 to balance the force Fx, the lever 3 will bend rearward or slide from the tongue 41. Accordingly, the electrical connection between the electrical connector 100 and the electronic package will be affected.

SUMMARY OF THE INVENTION

Accordingly, an object of the present invention is to provide an electrical connector assembly with a fasten mechanism including a stiffener, a load plate and a lever, the stiffener can support the lever for preventing the lever deformation and supply a well electrical connection.

In order to achieve the object set forth, an electrical connector assembly comprises a stiffener including a base with a first portion and a second portion, an insulative housing, a load plate and a lever. An embossed portion is formed on the base and has substantial distance to a first end of the first portion. An insulative housing is disposed between the first portion and the second portion. A load plate is pivotally mounted on the second portion of the stiffener. A lever is pivotally assembled to the first portion of the stiffener to lock the load plate and includes a retaining portion adjacent to the embossed portion to abut against the lever when it is rotated.

In order to further achieve the object set forth, a fasten mechanism used with an electrical connector comprises a stiffener having a base with a first portion and a second portion, a load plate pivotally mounted on the second portion of the base and a lever. The base has an embossed portion extending from the first portion. A lever is pivotally mounted on the first portion of the base and has a distance to a first end of the first portion of the base. The lever includes a retaining portion adjacent to the embossed portion for preventing the lever from bending during operation.

DESCRIPTION OF PREFERRED EMBODIMENT

Reference will now be made to the drawings to describe the present invention in detail.

Figure 1:
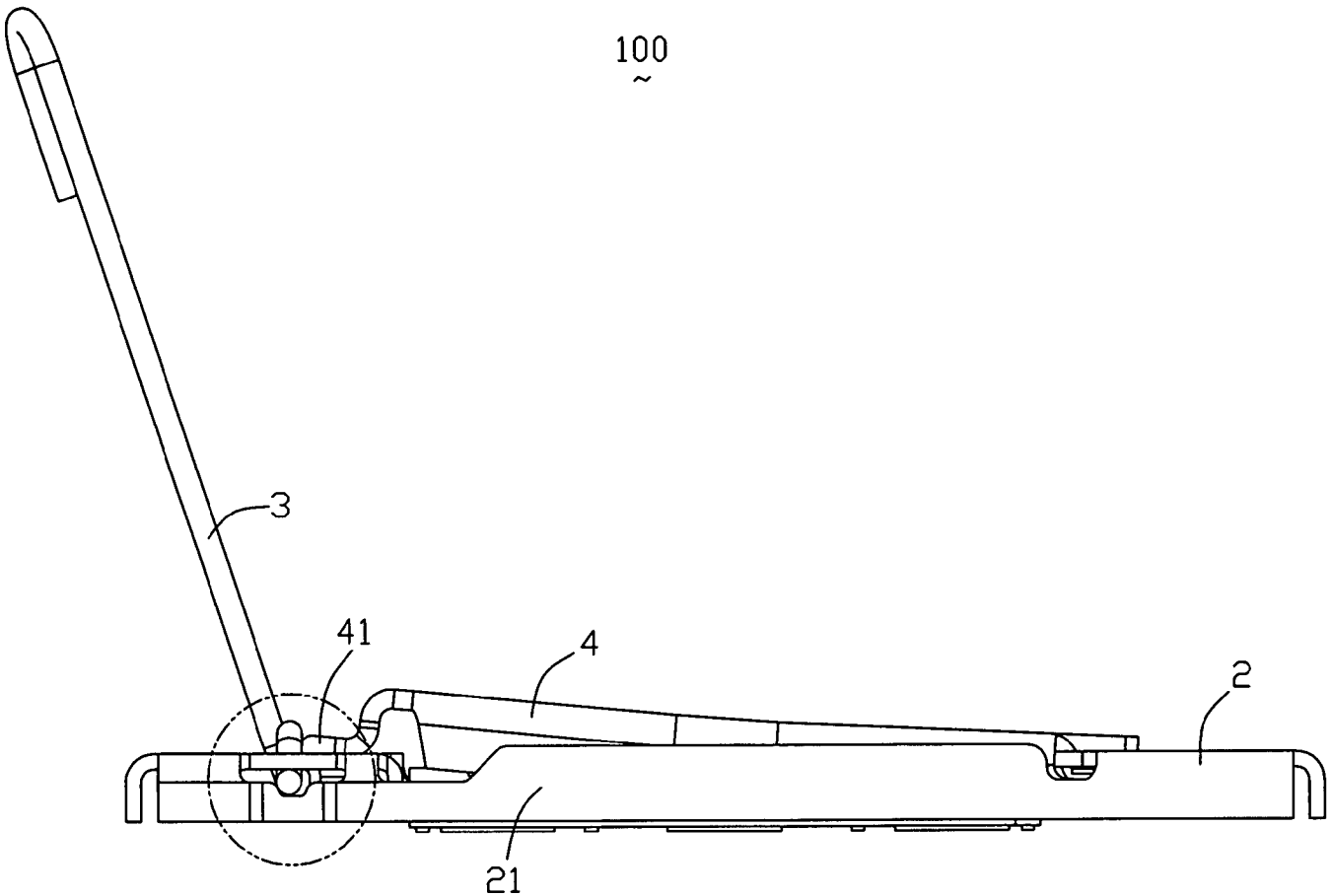
FIG. 1 (PRIOR ART)
FIG. 1 is a side view of a conventional electrical connector assembly.
Figure 2:
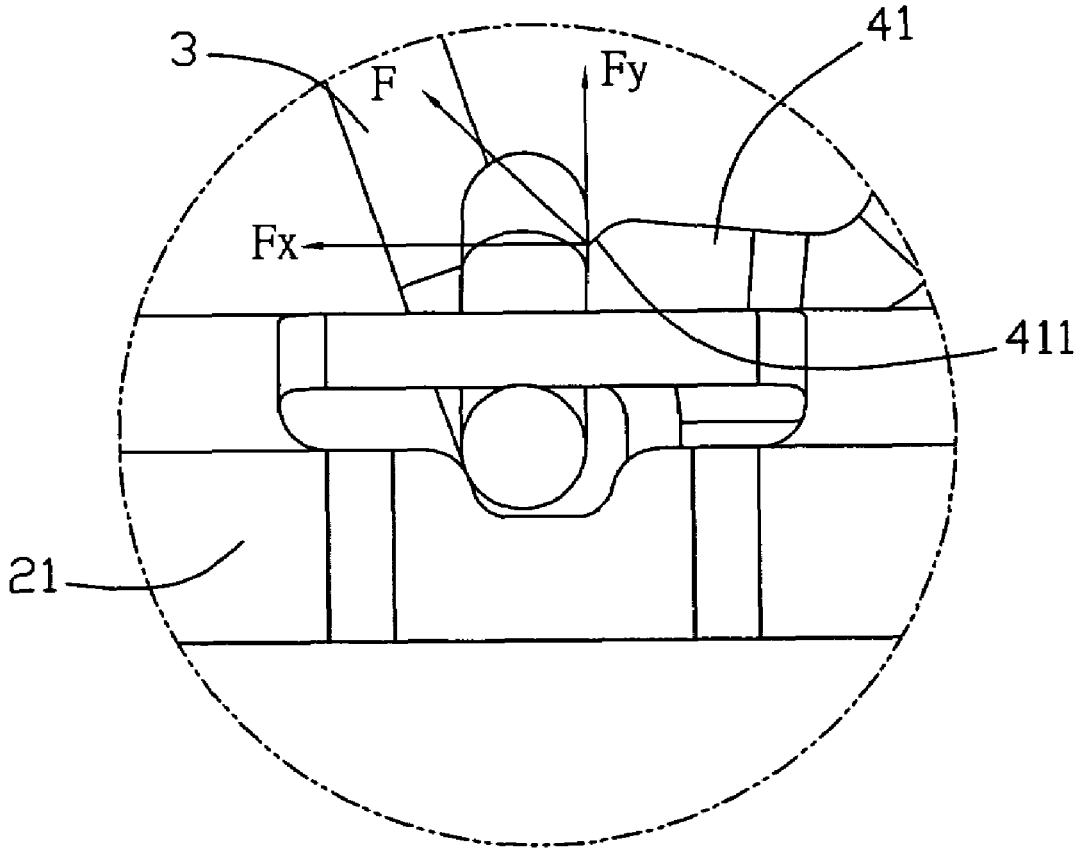
FIG. 2 (PRIOR ART)
FIG. 2 is an enlarged view of the conventional electrical connector assembly of FIG. 1.
Figure 3:
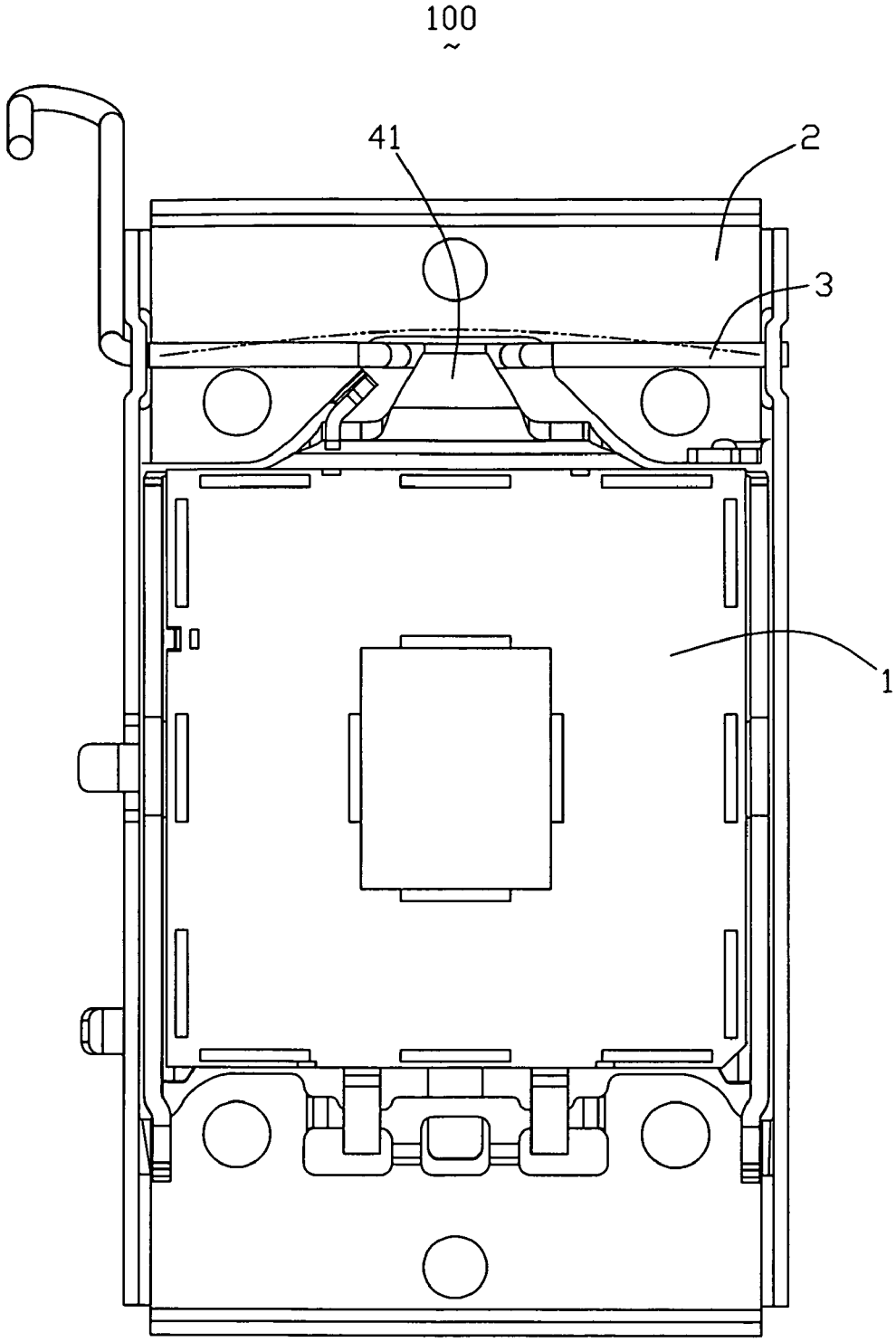
FIG. 3 (PRIOR ART)
FIG. 3 is a bottom view of the conventional electrical connector assembly.
Figure 4:
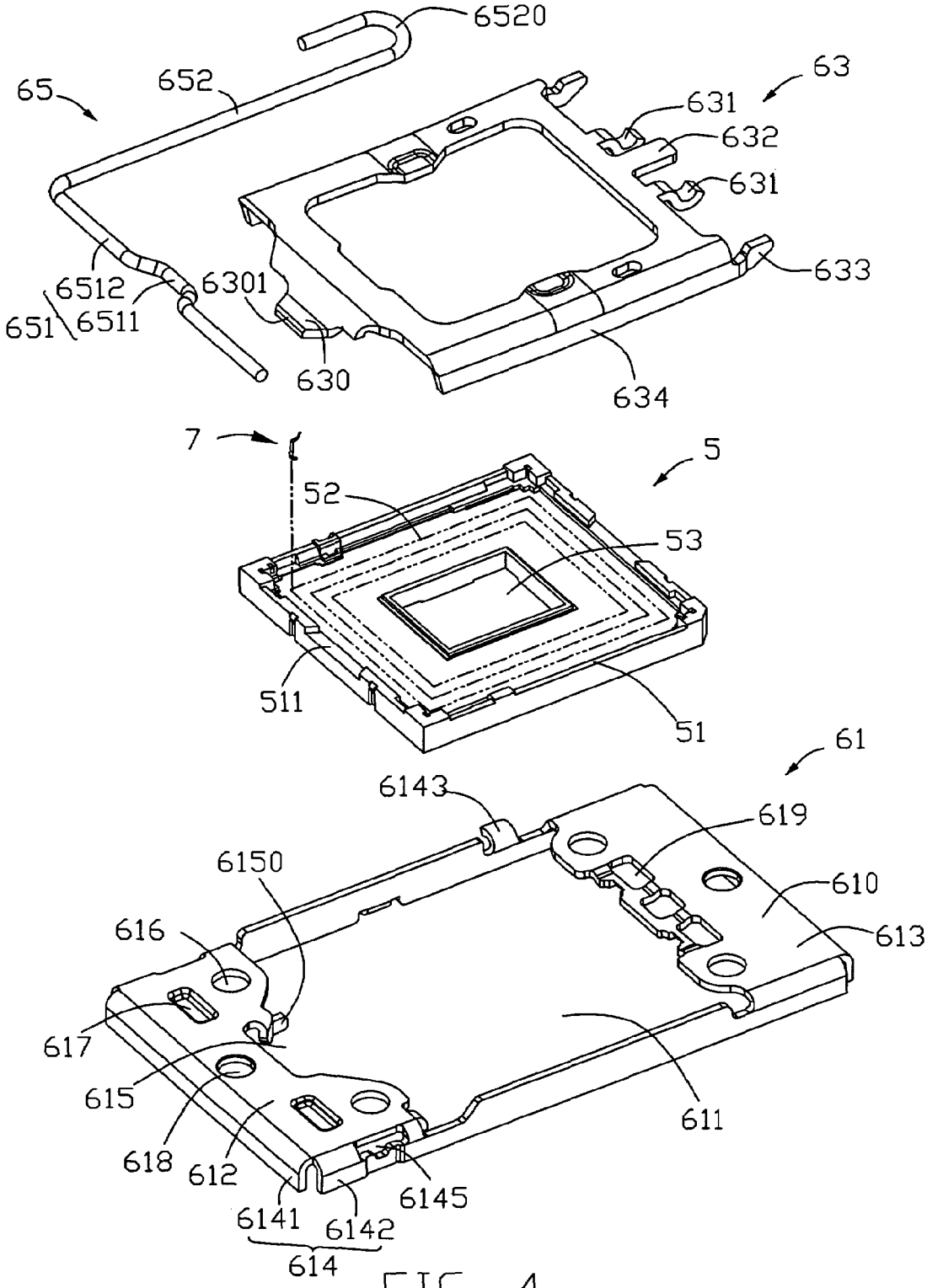
FIG. 4 is an exploded perspective view of an electrical connector assembly of the present invention.

Referring to FIG. 4, an electrical connector assembly of the present invention used to connect an electronic package (not shown) and a printed circuit board (not shown) comprises an insulative housing 5, a plurality of contacts 7 received in the insulative housing 5 and a fasten mechanism adapted to press the electronic package to the insulative housing 5.

The insulative housing 5 is substantially rectangular and is molded from resin or the like. The insulative housing 5 has a plurality of periphery sidewalls 51 to define a cavity 52 for receiving the electronic package. Two opposite sidewalls 51 each define a slot 511 adapt to facilitate to pick-up the electronic package from the cavity 52. The insulative housing 5 further defines an opening 52 extending therethrough. The insulative housing 5 also has a plurality of passageways (not labeled) around the opening 53 and disposed in a matrix for receiving the contacts 7. A plurality of bulges 54 are protruded from a bottom surface of the insulative housing 5. The bulges 54 are arranged in two circles, and one circle is disposed adjacent to the periphery of the insulative housing 5 and the other circle is disposed adjacent to the opening 53. The bulges 54 are against with the printed circuit board for preventing solder balls (not shown) at a bottom of the contacts 7 from over melting when the electrical connector assembly is welded on the printed circuit board.

The fasten mechanism includes a stiffener 61 surrounding the insulative housing 5, a load plate 63 pivotally mounted on one end of the stiffener 61 and a lever 65 pivotally assembled to the other end of the stiffener 61.

Figure 5:
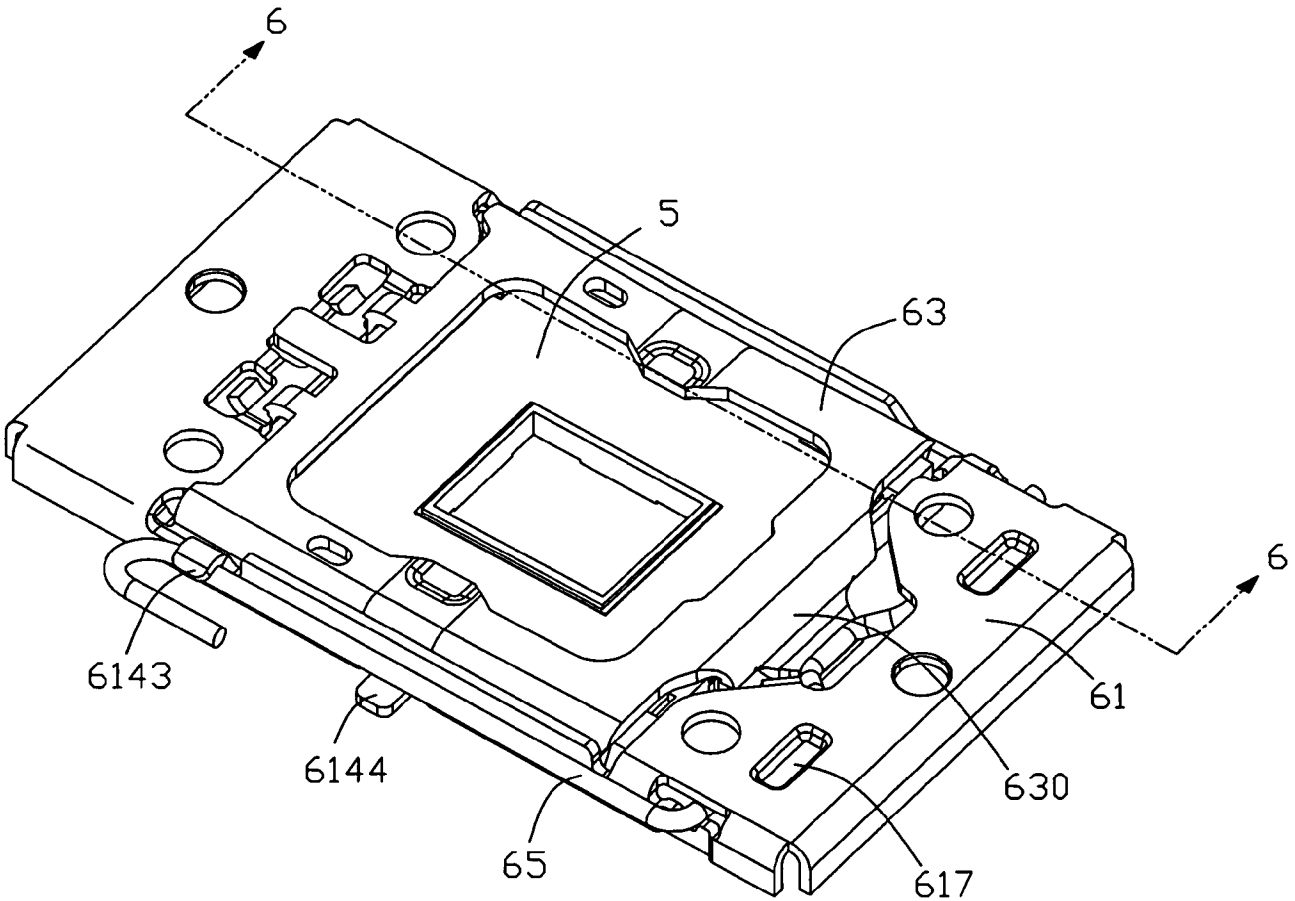
FIG. 5 is an assembled view of the electrical connector assembly shown in FIG. 4.

As shown in FIG. 4 and FIG. 5, the stiffener 61 includes a planar base 610 with a first portion 612 for supporting the lever 65 and a second portion 613 for supporting the load plate 63. An opening 611 is formed in a center of the stiffener 61 for receiving the insulative housing 5. The base 610 includes a plurality of perimeter sidewalls 614, that are respectively named rear and front sidewalls 6141, right and left sidewalls 6142. The first and second portion 612, 613 are connected together by the right and left sidewalls 6142. An upper interlocking portion 6143 is formed on one of the right and left sidewalls 6142 on an upper edge thereof for locking the lever 65 in a close position. A lower interlocking portion 6144 is formed in a middle of a bottom edge and at the same side with the upper interlocking portion 6143 for preventing the lever 65 over pressed. The first portion 612 has a T-shaped slot 6415 for supporting the lever 65. The T-shaped slot 6415 has a distance to the rear sidewall 6141 of the first portion 612. A trapezoid gap 615 is formed in a middle of the first portion 612 of the base 610 and a stopper 6150 extend downwardly from one inner side of the gap 615 adapted to prevent the lever 65 sliding out of the T-shaped slot 6415. A plurality of holes 616 are defined on the first and second portion 612, 613 of the base 610 on opposite sides of the gap 615. The first portion 612 of the base 610 is stamped downwardly to form two embossed portions 617 from an upper surface thereof. The embossed portions 617 have a distance to the rear sidewall 6141. Each of the first and second portion 612, 613 of the base 610 has a mating hole 618 respectively near the rear and front sidewalls 6141. The second portion 613 of the base 610 has two receiving openings 619 pivotally mounted on the load plate 63. A accommodate portion (not labeled) for receiving a portion of the load plate 63 is defined between the receiving openings 619. In the present invention, the first portion 612 is formed integrally with the second portion 613, and it also could be formed separately with the second portion 613.

The load plate 63 includes a rear end and a front end corresponding to the first portion 612 and second portion 613 of the stiffener 61, respectively. The load plate 63 has an opening in a center thereof. A tongue 630 is formed in a middle of the rear end of the load plate 63 and extends rearward and gradually shrinking. An incline 6301 is defined in a tip of the tongue 630. The front end of the load plate 63 has a pair of bearing tongues 631 that are curved downward and spaced from each other. A holding element 632 is formed between the bearing tongues 631. The holding element 632 is at the same height as the load plate 63 and is adapted to against the accommodate portion for supporting the load plate 63 when the load plate 63 at an open position. The load plate 63 further comprises a pair of supporting portions 633 that can against a bottom surface of the base 610 of the stiffener 61 when the load plate 63 at the close position. A pair of opposite sidewalls 634 extend downwardly from two sides of the load plate 63 and are positioned between the sidewalls 51 of the insulative housing 5 and the sidewalls 6142 of the stiffener 61.

The lever 65 includes an actuating portion 652 and a retaining portion 651 perpendicular to the actuating portion 652. The retaining portion 651 comprises rotary shafts 6512 which are spaced apart from one another and supported by the T-shaped slot 6415 of the stiffener 61. A locking portion 6511 is disposed between the rotary shafts 6512. The actuating portion 652 forms a U-shaped portion 6520 for actuating.

In assembly, first assemble the lever 65, the load plate 63 and the stiffener 61 together. The rotary shafts 6512 of the lever 63 are pivotally mounted on the T-shaped slot 6415 and stopped by the stopper 6150. The load plate 63 is pivotally mounted on the second portion 613 of the stiffener 61. The bearing tongues 631 of the load plate 63 are received in the receiving openings 619 of the stiffener 61 and can rotate respective to the stiffener 61. Second, assemble the insulative housing 5 and the stiffener 61 together and then put on the printed circuit board. The contacts 7 in the insulative housing 5 are welded on the printed circuit board via solder balls. A plurality of connecting elements (not shown) pass through the holes 616 of the stiffener 61 then attach to the printed circuit board. The mating holes 618 are adapt to connect a heat sink (not shown) member or the like.

Figure 6:
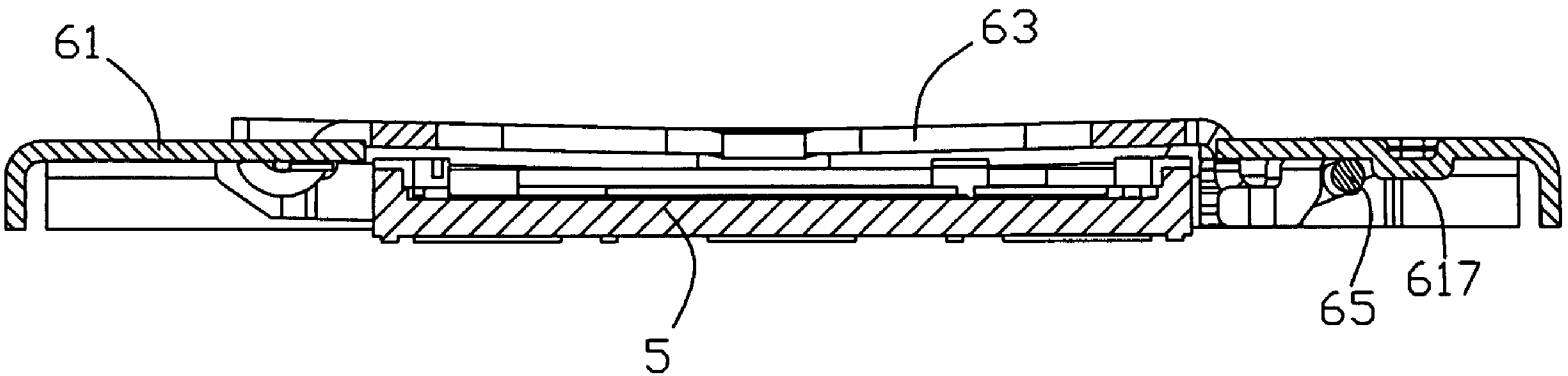
FIG. 6 is a cross-section view taken along line 6-6 of FIG. 5.
Figure 7:
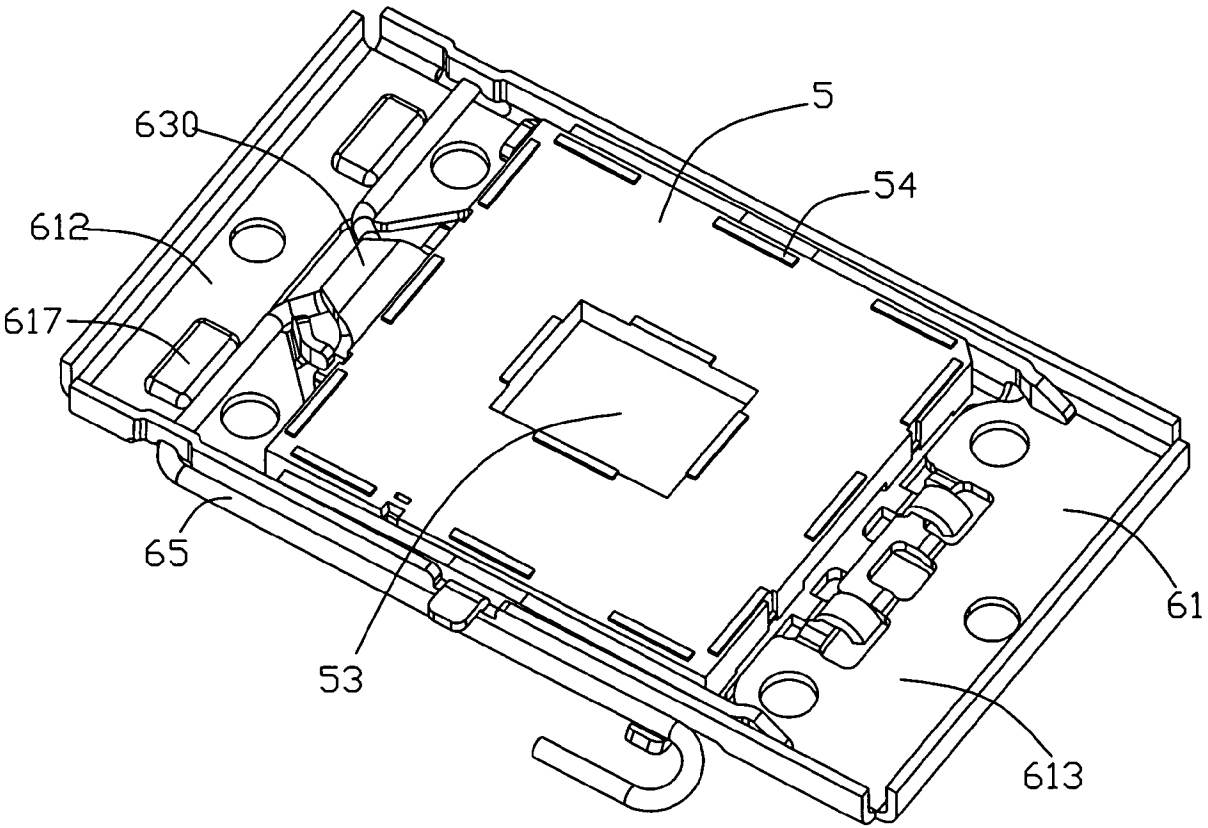
FIG. 7 is similar to FIG. 5, but from a different aspect.

As shown in FIG. 6 and FIG. 7, the embossed portions 617 are positioned adjacent to the lever 65 and just positioned on a rear side of the rotary shafts 6512. On that condition, when the lever 65 engages with the load plate 63, a rear force is exerted on the locking portion 6511 of the lever 65 by the tongue 630 of the load plate 63 and a balanced force is exerted by the embossed portions 617. Thus the lever 65 will not be rearward curved.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector assembly comprising:

a stiffener including a base with a first portion and a second portion, an embossed portion protruding downwardly from the base and having a substantially distance to a first end of the first portion;

an insulative housing disposed between the first portion and the second portion;

a load plate pivotally mounted on the second portion of the stiffener; and a lever pivotally assembled to the first portion of the stiffener to lock the load plate and including a retaining portion adjacent to the embossed portion to abut against the embossed portion when it is rotated.

2. The electrical connector assembly as claimed in claim 1, wherein the embossed portion is formed by drawing and is used for supporting the lever rotated with respect to the stiffener.

3. The electrical connector assembly as claimed in claim 1, wherein the first portion and the second portion are formed from one-piece and connected with each other by right and left sidewalls.

4. The electrical connector assembly as claimed in claim 3, wherein the right and the left sidewalls of the first portion have T-shaped slots to receive the lever.

5. The electrical connector assembly as claimed in claim 3, wherein the lever further comprises an actuating portion perpendicular to the retaining portion, the retaining portion further comprises a pair of rotary shafts mounted on the right and left sidewalls of the stiffener and a locking portion between the rotary shafts.

6. The electrical connector assembly as claimed in claim 5, wherein the embossed portion is located adjacent the rotary shafts.

7. The electrical connector assembly as claimed in claim 3, wherein the right and left sidewalls extend downwardly from the base.

8. A fastening mechanism used with an electrical connector comprising:

a stiffener having a base with a first portion and a second portion, the base having an embossed portion extending from the first portion;

a load plate pivotally mounted on the second portion of the base; and a lever pivotally mounted on the first portion of the base and having a distance to a first end of the first portion of the base, the lever including a retaining portion adjacent to the embossed portion for preventing the lever from bending during operation.

9. The fastening mechanism as claimed in claim 8, wherein the embossed portion is formed by stamping or drawing.

10. The fastening mechanism as claimed in claim 9, wherein the embossed portion downwardly projects from the stiffener with a slot in a top side of the stiffener.

11. The fastening mechanism as claimed in claim 8, wherein the stiffener has a front, a rear, a left and a right sidewalls extending downwardly from edges of the base.

12. The fastening mechanism as claimed in claim 11, wherein the left and right sidewalls connect with the first and the second portions.

13. The fastening mechanism as claimed in claim 11, wherein the lever further comprises an actuating portion perpendicular to the retaining portion, the retaining portion further comprises a pair of rotary shafts mounted on the right and left sidewalls of the stiffener and a locking portion between the rotary shafts.

14. The fastening mechanism as claimed in claim 13, wherein the embossed portion is located adjacent the rotary shafts.

15. An electrical connector comprising:

an insulative housing having therein a plurality of contacts with upwardly extending and exposed contacting sections;

a metallic stiffener including opposite first and second parts respectively located at opposite ends of said housing;

a metallic load plate pivotally mounted on the first part;

a metallic lever pivotally mounted on the second part, said lever including an actuating portion and a retaining portion linked to said actuating portion at essentially a right angle, said retaining portion having a middle locking portion being offset from two side rotary shafts which are located by two sides of the locking portion wherein said middle locking portion abuts against the load plate and the retaining portion is supported in corresponding T-shaped slots in the second part at two opposite ends respectively located at said side rotary shafts;

said second part further defining a stopper to laterally abut against the middle locking portion so as to keep the retaining portion in position.

16. The electrical connector as claimed in claim 15, wherein the second part further defines at least an embossed portion located between the middle locking portion and the corresponding end to abut against the corresponding side rotary shaft to counterbalance a forced upon the middle locking portion by the load plate.

* * * * *